US005502435A

United States Patent [19]

Ralston

[11] Patent Number: 5,502,435

[45] Date of Patent: Mar. 26, 1996

[54] METHOD AND SYSTEM FOR MONITORING CIRCUIT BREAKER GAS PRESSURE

[76] Inventor: Douglas E. Ralston, 6055 Deer Run Rd., Chagrin Falls, Ohio 44022

[21] Appl. No.: 223,759

[22] Filed: Apr. 6, 1994

[51] Int. Cl.[6] ..... G08B 21/00

[52] U.S. Cl. ..... 340/632; 340/605; 340/626; 340/638; 361/619; 364/558; 73/438; 73/30.02; 218/48

[58] Field of Search ..... 340/605, 611, 340/614, 626, 632, 638; 200/148 B, 148 E, 146 AA; 361/619; 364/558; 73/438, 30.2

[56] References Cited

U.S. PATENT DOCUMENTS

| | | | |
|---|---|---|---|
| 3,129,309 | 4/1964 | McKeough et al. | 200/148 B |
| 3,423,553 | 1/1969 | Pratsch | 200/148 B |
| 3,622,725 | 11/1971 | McConnell | 200/148 B |
| 3,646,804 | 3/1972 | Myers | 73/45.5 |
| 3,934,454 | 1/1976 | Simo | 73/29.02 |
| 4,398,187 | 8/1983 | Fukushima et al. | 340/638 |
| 4,598,381 | 7/1986 | Cucci | 364/558 |
| 4,866,640 | 9/1989 | Morrison | 364/558 |
| 4,914,943 | 4/1990 | Lagergren | 73/49.2 |
| 5,086,403 | 3/1990 | Slocum | 364/558 |
| 5,136,876 | 8/1992 | Taylor | 73/405 A |
| 5,201,212 | 4/1993 | Williams | 73/405 R |
| 5,388,451 | 2/1995 | Stendin et al. | 73/438 |

*Primary Examiner*—John K. Peng
*Assistant Examiner*—Edward Lefkowitz
*Attorney, Agent, or Firm*—Vickers, Daniels & Young

[57] ABSTRACT

A method and system are provided for monitoring the pressure of gas in a gas filled circuit breaker container based on a temperature compensated gas pressure signal which is compared with a signal representing a desired gas pressure in the container to provide a signal indicating a gas leak when the actual pressure is less than the desired pressure. In addition to identifying a gas leak, the method and system is operable to deactivate the circuit breaker when the actual pressure decreases below a predetermined low pressure, to determine the gas leak rate and to deactivate the circuit breaker if the leak rate is greater than a predetermined acceptable rate and, otherwise, to determine the time required for the pressure to decrease to the unacceptable low pressure, and to activate an alarm, visual display and/or recording of information in response to certain detected conditions with respect to the gas pressure.

35 Claims, 4 Drawing Sheets

FIG. 4
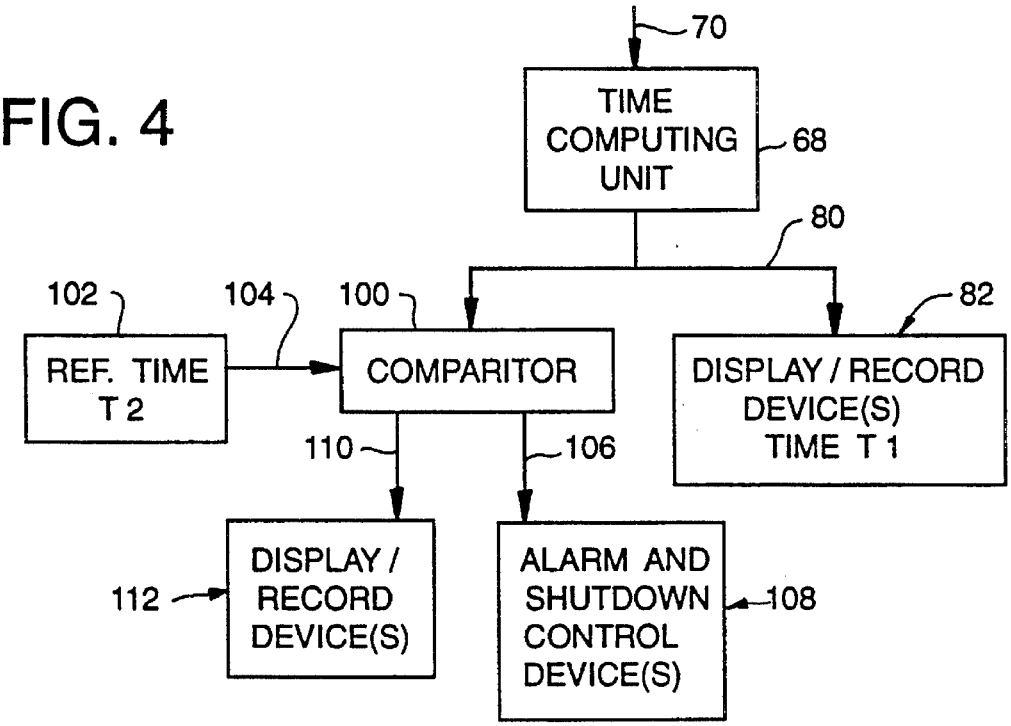
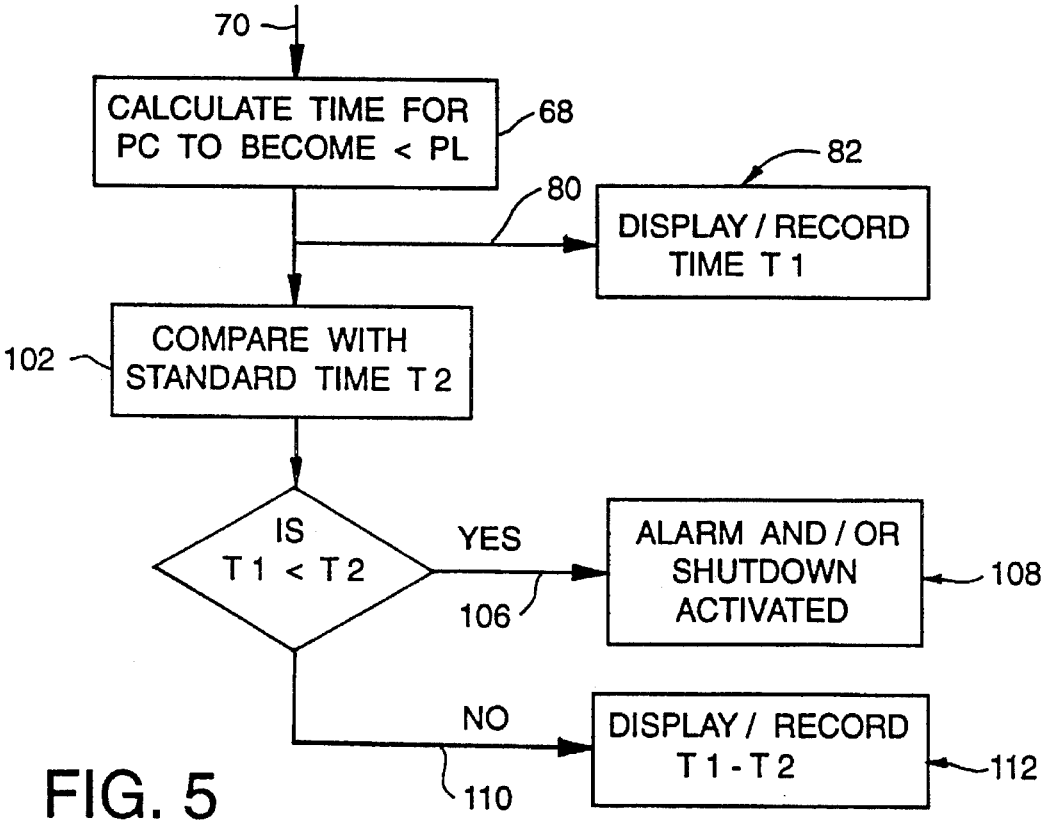
FIG. 5

METHOD AND SYSTEM FOR MONITORING CIRCUIT BREAKER GAS PRESSURE

BACKGROUND OF THE INVENTION

This invention relates to the art of pressurized gas circuit breakers and, more particularly, to an improved method and system for monitoring the pressure of gas in a circuit breaker container and responding to a fault condition relating to the gas pressure.

It is of course well known to provide a circuit breaker in a sealed housing containing an inert gas under pressure which extinguishes the arc which occurs when the breaker opens. It is likewise well known to provide such a circuit breaker with a pressure sensing arrangement and an alarm and/or control circuitry which operates to indicate and/or prevent operation of the circuit breaker in response to a gas leak from the container which results in a pressure drop below a predetermined low pressure level. Such an arrangement is shown, for example, in U.S. Pat. Nos. 3,129,309 to McKeough et al, 3,423,553 to Pratsch and 3,622,725 to McConnell, and the McKeough et al and Pratsch patents further disclose the use of temperature compensated pressure switches for controlling activation of alarm and circuit breaker shutdown devices.

While such pressure sensing arrangements of the foregoing character monitor gas pressure within the circuit breaker container to the extent that they respond to a drop in pressure below a predetermined minimum, they are purely mechanical devices having a set point which has to be mechanically adjusted up or down and which devices rely on a capillary bulb and bellows to provide the temperature compensation controlling switch operation. In addition to being structurally complex and difficult to apply to a breaker and to maintain with respect to the integrity of the temperature compensating capability thereof, all of which lends to an undesirable cost in connection with the construction, installation and maintenance of such systems, it is difficult to obtain and maintain a desired degree of accuracy with respect to the pressure sensing capabilities of such systems. Accordingly, there is a range of inaccuracy with respect to the point of operation of the alarm and/or shutdown control which can lead to a premature and unnecessary actuation of the alarm and/or shutdown control if the pressure in fact is above the acceptable minimum. More importantly, such inaccuracy can result in a dangerous situation if the pressure in the container drops below the acceptable minimum before activation of the alarm and/or shutdown control. Furthermore, the mechanical nature of such arrangements provides for the component parts thereof to be subject to wear and other deterioration which promotes inaccuracy as well as unreliability with respect to the operation thereof.

Moreover, systems of the foregoing character do not provide the capability of detecting a leak until such time as the gas pressure reaches the minimum level and, therefore, do not afford any opportunity to take corrective steps prior to a shutdown condition, or to monitor the leak such as for determining the rate thereof and the time prior to which the pressure will decrease to the minimum level. Accordingly, the monitoring capabilities of such mechanical systems are limited and insufficient and can be costly from the standpoint of downtime and the resulting inconvenience to customers whose power is supplied through the circuit breaker. In this respect, there is no capability of anticipating the point of a shutdown which would enable an intentional shutdown to take place during a time period which would be most convenient with respect to such customers.

SUMMARY OF THE INVENTION

In accordance with the present invention, a method and system is provided for electronically monitoring the gas pressure in a circuit breaker container in a manner whereby the foregoing problems and disadvantages encountered in connection with mechanical systems are advantageously avoided or overcome. More particularly in this respect, the method and system according to the present invention provides improved accuracy with respect to pressure measurements and determinations based thereon, and consistency with respect to repeated accuracy in connection with such measurements and determinations. Furthermore, the method and system according to the present invention advantageously enables detecting a gas leak at or near the first occurrence thereof and, based thereon, enables determinations providing the basis for anticipating the need and/or time for taking corrective actions. Such determinations include, for example, the rate of the gas leak, whether the gas leak rate is acceptable and, if so, the length of time available before the gas pressure decreases to the minimum acceptable level. Moreover, the method and system according to the present invention advantageously provides for visually and/or audibly indicating and/or recording a number of different conditions with respect to the gas pressure in the circuit breaker container as well as the ability to disable or shutdown the circuit breaker in response to or in anticipation of the gas pressure decreasing to the minimum acceptable level. Accordingly, a large array of monitoring parameters are available, all of which optimize the monitoring capability with respect to a given circuit breaker and the efficiency of such monitoring with respect to the information available and upon which alternative or optional decision making is possible, thus to optimize the efficiency with respect to which problems involving a given circuit breaker are resolved.

It is accordingly an outstanding object of the present invention to provide an improved method and system for monitoring the pressure of gas in a gas filled circuit breaker.

Another object is the provision of a method and system of the foregoing character having improved accuracy with respect to responding to a fault condition.

Yet another object is the provision of a method and system of the foregoing character which is capable of monitoring gas pressure in a circuit breaker container between a desired pressure to be maintained in the container and a minimum acceptable pressure.

A further object is the provision of a method and system of the foregoing character which is operable to detect a gas leak in the container at or near the time of inception thereof and to provide a variety of data regarding the gas leak so as to optimize the ability to take corrective action at the most opportune time.

Still a further object is the provision of a method and system of the foregoing character by which the accuracy of response to pressure conditions in a circuit breaker container optimizes shutdown of a circuit breaker in response to a predetermined minimum pressure in the container while avoiding the unnecessary or untimely shutdown of the circuit breaker prior to reaching the low pressure level.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which:

FIG. 4 is a block diagram showing an additional feature of the monitoring system; and FIG. 5 is a flow chart operation of the additional feature shown in FIG. 4.

DESCRIPTION OF A PREFERRED EMBODIMENT

Figure 1:
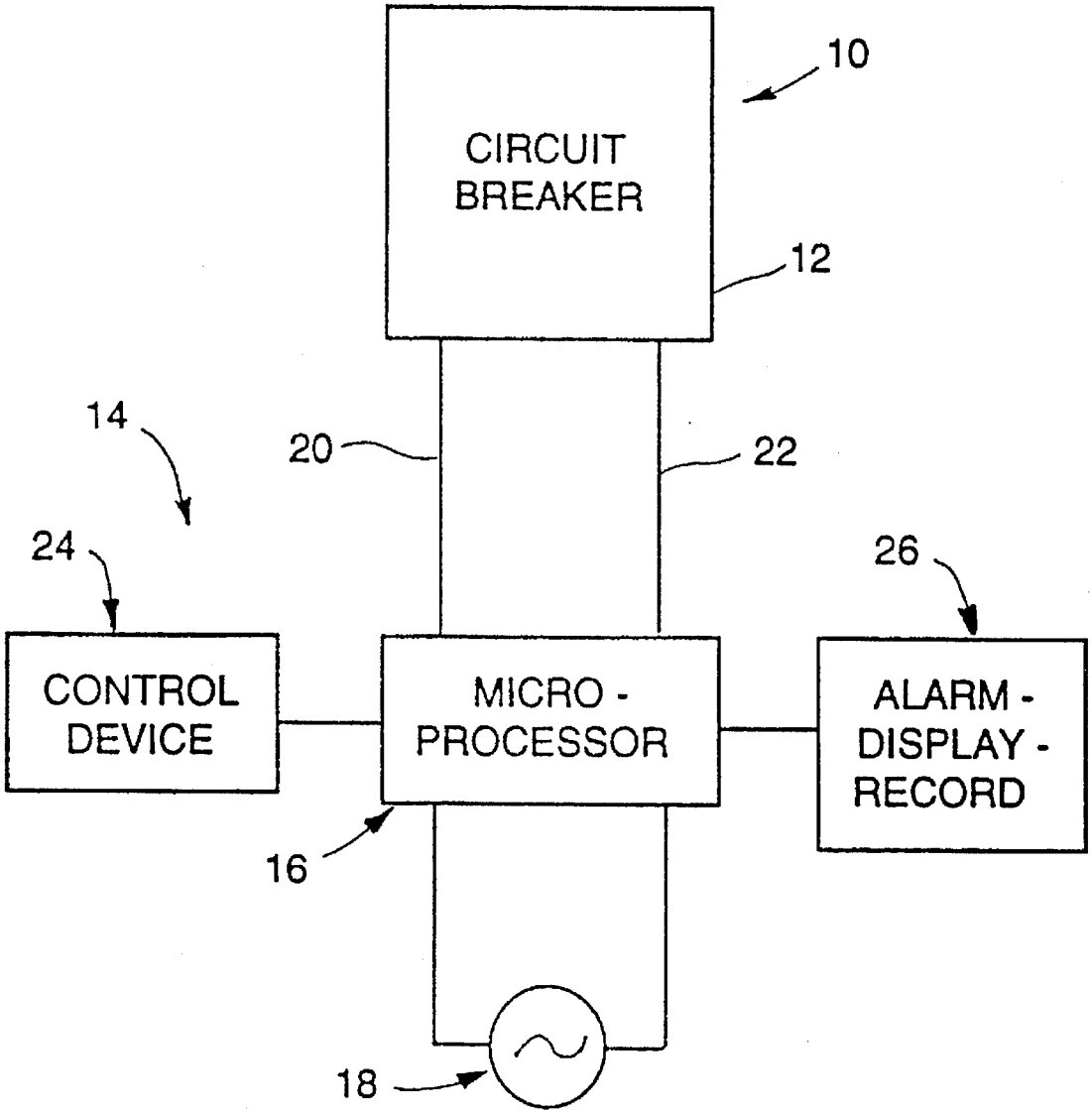
FIG. 1 is a schematic illustration of a gas circuit breaker having a monitoring system according to the invention.
Figure 2:
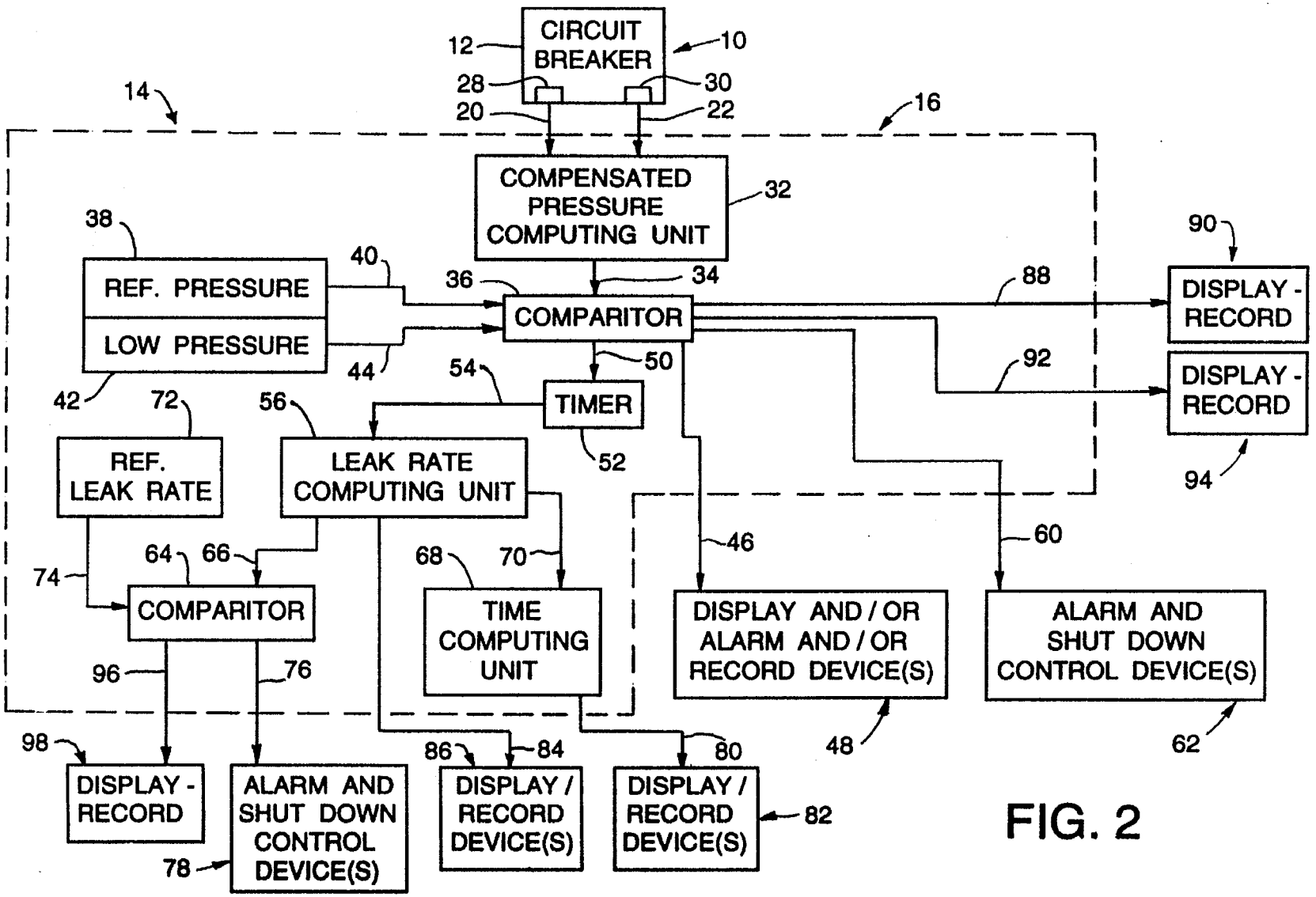
FIG. 2 is a block diagram of the monitoring system.

Referring now in greater detail to the drawings, wherein the showings are for the purpose of illustrating a preferred embodiment of the invention only and not for the purpose of limiting the invention, FIGS. 1 and 2 schematically illustrate a gas circuit breaker 10 comprising a sealed container 12 housing the circuit breaker apparatus and containing an inert gas under pressure which extinguishes the arc which occurs when the breaker opens. In accordance with the present invention, the circuit breaker is provided with a monitoring system 14 comprising a microprocessor 16 connected to a suitable source of electrical power 18 and receiving pressure and temperature input information from the circuit breaker through leads 20 and 22, respectively. As will become more apparent hereinafter, microprocessor 16 is operable in response to such pressure and temperature input information to detect a gas leak in circuit breaker container 12 and, in response thereto, to provide a variety of monitoring functions including, for example, outputting a signal to a control device 24 which is operable to shutdown or otherwise deactivate the circuit breaker under appropriate circumstances, and outputting signals to alarm, display and/or recording devices, designated generally by numeral 26 in FIG. 1, and which signals are representative of a variety of gas pressure and gas leak conditions in the circuit breaker container, as will become more apparent hereinafter.

Figure 3:
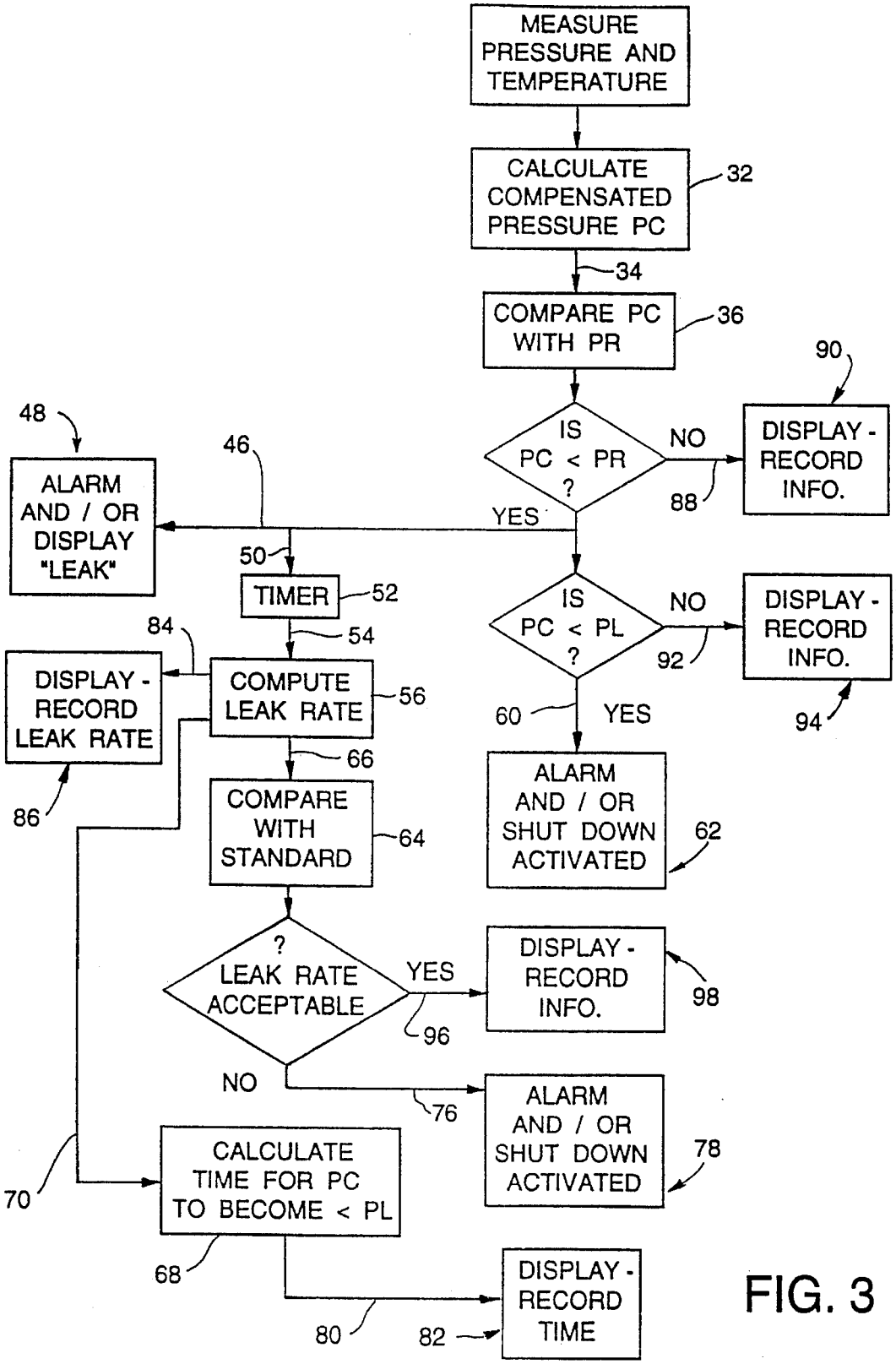
FIG. 3 is a flow chart of the operation of the system.

Referring now in particular to FIGS. 2 and 3 of the drawing, lead 20 is connected to a pressure measuring device such as a transducer 28 in circuit breaker container 12, and lead 22 is connected to a temperature measuring device such as a thermistor 30 which, while shown as being in circuit breaker container 12, can be outside the container. The outputs of the transducer and thermistor are, or are converted to be, digital for input to microprocessor 16. The output signal through lead 20 from transducer 28 is representative of the measured pressure PM in container 12, and the signal outputted through lead 22 from thermistor 30 is representative of the measured temperature TM. These signals are fed to a compensated pressure computing unit 32 as input to a stored equation therein, and computing unit 32 outputs a signal through line 34 to a comparator 36 and which signal is representative of the temperature compensated gas pressure PC in circuit breaker container 12. A first reference signal generator 38 outputs a signal through line 40 to comparator 36 representative of a desired reference pressure PR to be maintained in circuit breaker container 12, and a second reference signal generator 42 outputs a signal through line 44 to comparator 36 representative of a minimum acceptable low pressure PL for the gas in circuit breaker container 12.

Reference pressure PR and compensated pressure PC are compared in comparator 36 and, unless the compensated pressure is less than the reference pressure, there is no output from comparator 36, although it will be appreciated as set forth hereinafter that this information could be displayed and/or recorded if so desired. If the compensated pressure PC is less than the reference pressure PR, which indicates a gas leak in circuit breaker container 12, comparator 36 outputs signals representing the pressure drop through lines 46 and 50 respectively to a display, alarm and/or recording device or devices 48 and to a timer 52. Timer 52 periodically outputs the pressure drop signal through line 54 to a leak rate computing unit 56 for the purpose set forth hereinafter. Device or devices 48 indicate the fault condition, in this instance a gas leak in container 12, and can, for example, display the information on a screen, actuate an audible alarm such as a horn or a visible alarm such as a flashing light, and/or record the information in the microprocessor memory and/or by printout. Comparator 36 also compares the compensated pressure signal PC with the low pressure reference signal PL from reference signal generator 42 and, if the compensated pressure is less than the minimum acceptable low pressure, the comparator outputs a signal representing this pressure differential through line 60 to an alarm and shutdown control device or devices 62 which respectively visually and/or audibly indicate the alarm condition and shutdown or otherwise deactivate circuit breaker 10. Assuming that a leak has been detected as described above causing an output signal from comparator 36 through line 50 to timer 52, and assuming that the pressure drop in container 12 provides for the compensated pressure PC to be less than the desired reference pressure but greater than the minimum acceptable pressure PL, timer 52 as mentioned above periodically outputs the pressure drop signal to leak rate computing unit 56 through line 54. Based on the time between successive signals outputted from timer 52 to computing unit 56, and changes in the pressure drop in container 12 between the succeeding signals, computing unit 56 calculates the rate at which gas is leaking from circuit breaker container 12. Computing unit 56 outputs signals representative of the leak rate to a comparator 64 through line 66 and to a time computing unit 68 through line 70. A reference signal generator 72 outputs a leak rate reference signal to comparator 64 through line 74 and which reference signal is representative of a standard or acceptable rate of gas leakage from circuit breaker container 12. The computed leak rate and reference leak rate signals are compared in comparator 64, and if the computer leak rate exceeds the acceptable leak rate comparator 64 outputs a signal through line 76 to an alarm and shutdown control device or devices 78 which respond by issuing an audible and/or visible alarm and by shutting down or otherwise disabling circuit breaker 10.

Based on succeeding leak rate input signals from computing unit 56 through line 70 to time computing unit 68, the latter calculates the time required, at the current leak rate, for the gas pressure in circuit breaker container 12 to decrease to the minimum acceptable level. Computing unit 68 outputs a signal representative of this time through line 80 to a display and/or recording device or devices 82 which respond by displaying the time information on a screen and/or recording the information in the microprocessor memory and/or by printout. The current leak rate computed in response to succeeding signals to computing unit 56 from timer 52 is also displayed and/or recorded. In this respect, leak rate computing unit 56 outputs a signal representing the leak rate through line 84 to a display and/or recording device or devices 86 which respond in the manner of the device or devices 82 referred to above.

It will be appreciated that the output signal from time computing unit 68 through line 80 to display and/or recording device or devices 82 is also representative of the time T1 remaining before the system reaches a shut down condition in that the circuit breaker is shut down or otherwise deactivated when the gas pressure in circuit breaker container 12 decreases to the minimum acceptable level. This time T1 is the information displayed and/or recorded by device or devices 82 as described above. Preferably, as will be appreciated from FIGS. 4 and 5 of the drawing, time computing unit 68 also outputs the signal representative of time T1 to a comparator 100 which receives an input signal representative of a reference time T2 from a reference signal generator 102 through line 104. Time T2 is a desired minimum time remaining before reaching a shutdown condition, and if comparator 100 determines that T1 is less than T2 the comparator outputs a signal through line 106 to an alarm and shutdown control device or devices 108 which respond by issuing an audible and/or visible alarm and by shutting down or otherwise disabling circuit breaker 10. If, on the other hand, comparator 100 determines that T1 is greater than T2 the comparator outputs a signal through line 110 to a display and/or recording device or devices 112 which respond by displaying the difference between times T1 and T2 on a screen and/or recording the information in the micro processor memory and/or by printout. Thus, it will be appreciated that display and/or recording device or devices 82 indicate the time remaining before an unacceptable low pressure is reached in circuit breaker container 12, and display and/or recording device or devices 112 indicate the time remaining before an unacceptable time period is reached with respect to a shutdown condition. This feature advantageously provides an alternative basis for determining when a shut down of the circuit breaker is desired, and provides a back-up to shut down the circuit breaker in the event that either one or both of the devices 62 and 78 should fail to operate.

As will be appreciated from the description thus far, the monitoring system is adapted to detect fault conditions, beginning with the detection of a gas leak, and to indicate a fault such as by shutting down or otherwise disabling the circuit breaker, by activating an audible and/or visual alarm, by displaying the fault such as on a screen and/or by recording the fault by printout and/or storage in the microprocessor's memory. In addition to indicating such a fault, it may be desirable to indicate non-fault information which is not used as input for fault related functions of the system. In this respect, for example, and as is further shown in FIGS. 2 and 3, if the compensated pressure signal PC inputted to comparator 36 is not less than reference pressure signal PR inputted to the comparator, thus indicating no leak in container 12, the comparator can output a signal representative of this fact through line 88 to a display and/or recording device or devices 90. Similarly, if the compensated pressure PC is less than the reference pressure PR but greater than the minimum low pressure PL, the comparator can output a signal indicative of this fact through line 92 to a display and/or recording device or devices 94. As another example, if the rate of leakage of gas from container 12 is within the acceptable range as determined by comparator 64 based on input from leak rate computing unit 56 and reference leak rate signal generator 72, comparator 64 can output a signal representative of this fact through line 96 to a display and/or recording device or devices 98. Still further, while not shown, it will be appreciated that it may be desirable to display and/or record the pressure and temperature measured by transducer 28 and thermistor 30, and the compensated pressure calculated by computing unit 32.

While considerable emphasis has been placed herein on the preferred embodiments, it will be appreciated that many changes can be made in the preferred embodiments without departing from the principles of the invention. Accordingly, it is to be distinctly understood that the foregoing descriptive matter is to be interpreted merely as illustrative of the invention and not as a limitation.

Having thus described the invention it is claimed:

1. A system for monitoring the pressure of gas in a gas filled circuit breaker container in which said gas has a pressure and a temperature comprising, means for producing a first signal representative of a temperature compensated gas pressure in said container, means for providing a second signal representative of a reference gas pressure in said container, comparator means including means for comparing said first and second signals and providing a third signal in response to said first signal being less than said second signal, thus indicating a drop in pressure in said container from said reference pressure, and means responsive to said third signal including means for indicating said pressure drop.

2. A system according to claim 1, wherein said means for producing said first signal includes means producing a signal representative of the pressure of the gas in said container, means producing a signal representative of the temperature of the gas in said container, and means for calculating said temperature compensated pressure based on said pressure and said temperature signals.

3. A system according to claim 1, and means for providing a low pressure reference signal representative of a minimum acceptable pressure in said container, said comparator means including means for comparing said first signal and said low pressure reference signal and providing a control signal in response to a drop in pressure in said container below said minimum acceptable pressure, and means responsive to said control signal for indicating that said compensated pressure is below said minimum acceptable pressure.

4. A system according to claim 3, wherein said means responsive to said control signal includes means for disabling said circuit breaker.

5. A system according to claim 4, wherein said means responsive to said control signal includes alarm means.

6. A system for monitoring the pressure of gas in a gas filled circuit breaker container in which said gas has a pressure and a temperature comprising, means for producing a first signal representative of a temperature compensated gas pressure in said container, means for providing a second signal representative of a reference gas pressure in said container, comparator means including means for comparing said first and second signals and providing a third signal in response to said first signal being less than said second signal, thus indicating a drop in pressure in said container from said reference pressure, and means responsive to said third signal including means for indicating said pressure drop, said means responsive to said third signal further including means for producing a leak rate signal representative of the rate of said pressure drop in said container.

7. A system according to claim 6, and means responsive to said leak rate signal for indicating said rate of pressure drop.

8. A system according to claim 7, wherein said means responsive to said leak rate signal includes at least one of means for displaying and means for recording said rate of pressure drop.

9. A system according to claim 6, and means providing a leak rate reference signal representative of an acceptable rate of pressure drop in said container, said comparator means including means for comparing said leak rate signal and said leak rate reference signal and providing a leak rate control signal in response to said leak rate signal exceeding said leak rate reference signal, and means responsive to said leak rate control signal for indicating an unacceptable rate of pressure drop in said container.

10. A system according to claim 9, wherein said means responsive to said leak rate control signal includes means for disabling said circuit breaker.

11. A system according to claim 10, wherein said means responsive to said leak rate control signal includes alarm means.

12. A system according to claim 6, and time computing means for receiving said leak rate signal and providing a time control signal representative of the time for the pressure in said container to drop below a minimum acceptable pressure, and means responsive to said time signal for indicating said time.

13. A system according to claim 12, wherein said means responsive to said time control signal includes at least one of means for displaying and means for recording said time.

14. A system according to claim 6, and time computing means for receiving said leak rate signal and providing a time signal representative of the time for the pressure in said container to drop below a minimum acceptable pressure, means providing a reference time signal representative of a minimum acceptable time for said pressure to drop below said minimum acceptable pressure, time signal comparator means for comparing said time signal and said reference time signal and providing a control signal in response to said time signal being less than said reference time signal, and means responsive to said control signal for disabling said circuit breaker.

15. A system according to claim 14, wherein said time signal comparator means provides a time differential signal in response to said time signal being greater than said reference signal, and means responsive to said differential signal for indicating said time differential.

16. A system according to claim 15, and means responsive to said time signal for indicating said required time.

17. A system for monitoring the pressure of gas in a gas filled circuit breaker container in which said gas has a pressure and a temperature comprising, means for producing a first signal representative of a temperature compensated gas pressure in said container, means for providing a second signal representative of a reference gas pressure in said container, comparator means including means for comparing said first and second signals and providing a third signal in response to said first signal being less than said second signal, thus indicating a drop in pressure in said container from said reference pressure, means responsive to said third signal including means for indicating said pressure drop, means for providing a low pressure reference signal representative of a minimum acceptable pressure in said container lower than said reference pressure, said comparator means further including means for comparing said first signal and said low pressure reference signal and providing a control signal in response to a drop in pressure in said container below said minimum acceptable pressure, means responsive to said control signal for indicating that the pressure in said container is below said minimum acceptable pressure, said means responsive to said third signal including means for producing a leak rate signal representative of the rate of said pressure drop in said container, and means responsive to said leak rate signal for indicating said rate of pressure drop.

18. A system according to claim 17, wherein said means for producing said first signal includes means producing a signal representative of the pressure in said container, means producing a signal representative of the temperature of the gas in said container, and means for calculating said temperature compensated pressure based on said pressure and said temperature signals.

19. A system according to claim 17, and means providing a leak rate reference signal representative of an acceptable rate of pressure drop in said container, said comparator means including means for comparing said leak rate signal and said leak rate reference signal and providing a leak rate control signal in response to said leak rate signal exceeding said leak rate reference signal, and means responsive to said leak rate control signal for indicating an unacceptable rate of pressure drop in said container.

20. A system according to claim 17, and time computing means receiving said leak rate signal and providing a time signal representative of a time for the pressure in said container to drop below said minimum acceptable pressure, and means responsive to said time signal to indicate said time.

21. A system according to claim 20, and means providing a leak rate reference signal representative of an acceptable rate of pressure drop in said container, said comparator means including means for comparing said leak rate signal and said leak rate reference signal and providing a leak rate control signal in response to said leak rate signal exceeding said leak rate reference signal, and means responsive to said leak rate control signal for indicating an unacceptable rate of pressure drop in said container.

22. A system according to claim 21, further including means providing a reference time signal representative of a minimum acceptable time for said pressure to drop below said minimum acceptable pressure, time signal comparator means for comparing said time signal and said reference time signal and providing a second control signal in response to said time signal being less than said reference time signal, and means responsive to said second control signal for disabling said circuit breaker.

23. A system according to claim 22, wherein said time signal comparator means provides a time difference signal in response to said time signal being greater than said reference time signal, and means responsive to said difference signal for indicating the time represented by said time difference signal.

24. A system according to claim 22, wherein said means for producing said first signal includes means producing a signal representative of the pressure in said container, means producing a signal representative of the temperature of the gas in said container, and means for calculating said temperature compensated pressure based on said pressure and said temperature signals.

25. A system according to claim 24, wherein said means responsive to said control signal and said leak rate control signal includes means for disabling said circuit breaker.

26. A system according to claim 25, wherein said means responsive to said control signal and said leak rate control signal includes alarm means.

27. A system according to claim 26, wherein said means responsive to said time signal and said leak rate signal includes at least one of means for displaying and means for recording said required time and said rate of pressure drop, respectively.

28. A method of monitoring the pressure of gas in a gas filled circuit breaker container in which said gas has a pressure and a temperature comprising, determining a temperature compensated pressure of the gas in said container, comparing said temperature compensated pressure with a first reference pressure representing a predetermined pressure for said gas in said container to detect a pressure drop in said container, comparing said temperature compensated pressure with a second reference pressure representing a minimum acceptable pressure in said container, and disabling said circuit breaker at least in response to said temperature compensated pressure being less than said second reference pressure.

29. A method of monitoring the pressure of gas in a gas filled circuit breaker container in which said gas has a pressure and a temperature comprising, determining a temperature compensated pressure of the gas in said container, comparing said temperature compensated pressure with a first reference pressure representing a predetermined pressure for said gas in said container to detect a pressure drop in said container, comparing said temperature compensated pressure with a second reference pressure representing a minimum acceptable pressure in said container, and disabling said circuit breaker at least in response to said temperature compensated pressure being less than said second reference pressure, and determining the rate of pressure drop when said temperature compensated pressure is less than said first reference pressure.

30. The method according to claim 29, and determining a time for said temperature compensated pressure to decrease to said second reference pressure based on the determined rate of pressure drop.

31. The method according to claim 30, and comparing the determined time with a predetermined rate of pressure drop.

32. The method according to claim 29, and comparing the determined rate of pressure drop with a predetermined time.

33. The method according to claim 32, and disabling said circuit breaker if said determined rate is above said predetermined rate.

34. The method according to claim 33, and determining a time for said temperature compensated pressure to decrease to said second reference pressure based on the determined rate of pressure drop.

35. The method according to claim 34, and comparing the determined time with a predetermined time and disabling said circuit breaker if said determined time is less than said predetermined time.

* * * * *